US008167606B2

(12) United States Patent
Yang

(10) Patent No.: US 8,167,606 B2
(45) Date of Patent: May 1, 2012

(54) APPARATUS AND METHOD FOR FORMING PANEL

(75) Inventor: Seung Eun Yang, Chungcheongbuk-do (KR)

(73) Assignee: Micro Contact Solution Co, Ltd., Chungcheongnamdo (KR)

( * ) Notice: Subject to any disclaimer, the term of this patent is extended or adjusted under 35 U.S.C. 154(b) by 319 days.

(21) Appl. No.: 12/642,083

(22) Filed: Dec. 18, 2009

(65) Prior Publication Data

US 2010/0252954 A1 Oct. 7, 2010

(30) Foreign Application Priority Data

Apr. 6, 2009 (KR) ..... 10-2009-0029305

(51) Int. Cl.
*B28B 11/08* (2006.01)
*B65H 45/14* (2006.01)

(52) U.S. Cl. ..... 425/520; 425/396; 264/282

(58) Field of Classification Search ..... 264/282; 425/520, 443, DIG. 58, 343, 396; 156/205, 156/206, 210, 221
See application file for complete search history.

(56) References Cited

U.S. PATENT DOCUMENTS 4,948,355 A * 8/1990 Knoll ..... 425/517

FOREIGN PATENT DOCUMENTS

KR 10-0586410 5/2006

* cited by examiner

*Primary Examiner* — Joseph Del Sole
*Assistant Examiner* — Kimberly A Stewart
(74) *Attorney, Agent, or Firm* — Scully, Scott, Murphy & Presser, P.C.

(57) ABSTRACT

Disclosed herein is an apparatus and method for forming a panel. The apparatus includes a first mold unit may include a right-angled upper mold provided on the front portion of an upper mold to reciprocate vertically, and a right-angled lower mold provided on the front portion of a lower mold, thus compressing base materials to impart a pattern of a right triangular waveform. A second mold unit may include an obtuse upper mold provided on the central portion of the upper mold to reciprocate in a direction inclined relative to a progressing direction of the base materials, and an obtuse lower mold provided on the central portion of the lower mold, thus compressing the base materials to impart a pattern of an obtuse triangular waveform. A third mold unit may be provided behind the second mold unit and linearly presses the base materials in a direction from front to rear.

6 Claims, 6 Drawing Sheets

APPARATUS AND METHOD FOR FORMING PANEL

BACKGROUND OF THE INVENTION

1. Field of the Invention

The present invention relates generally to an apparatus and method for forming a panel and, more particularly, to an apparatus and method for forming a panel, in which a first process of forming a right triangular waveform on a plurality of base materials, a second process of forming an obtuse triangular waveform, and a third process of linearly pressing the base materials in a direction from front to rear to attach the base materials to each other are conducted by a single apparatus, thus allowing the panel to be rapidly formed.

2. Description of the Related Art

Generally, a waveform panel is obtained by forming a waveform on a panel, and is characterized in that load and reaction force are uniformly distributed throughout the panel owing to the waveform, thus having a large load-carrying capacity. By overlapping several waveform panels with each other or joining the waveform panels to each other using bolts, they are used as a plate. Further, by providing curvature to the waveform panels and coupling the waveform panels to each other, they are used as a pipe.

Generally, in order to form a waveform when manufacturing the waveform panel, molds having waveforms of one pitch or two pitches are provided on the upper and lower portions of a pressing device. After a panel is inserted between the molds, the upper mold is pressed by the pressing device, so that waveforms of one or two pitches are formed on the panel.

Subsequently, the panel is moved in a longitudinal direction by a distance corresponding to one pitch or two pitches, and the waveform is formed on the panel by one or two pitches using the molds. Thus, the waveform forming process can form several tens of waveforms on one panel in a longitudinal direction.

Next, in a hole forming process, in order to use bolts to couple panels having the waveforms to each other, bolt fastening holes are formed in the edge of each panel. In such a hole forming process, a plurality of holes is formed in the roots or crests of each panel using a punch. A plurality of panels having the holes formed as such is coupled using fastening means such as bolts so as to be used for a structure or other purposes.

However, even though the edges of panels are fastened to each other using bolts to couple the panels to each other, the central portions of the panels are not fastened, so that a coupling force between the panels is weak.

Further, when strong external force is exerted on the entire panel at one time, for example, when the waveform is formed on the panel at one time through pressing, the panel may undesirably tear or be damaged.

Meanwhile, as the related art, Korean Patent No. 10-0586410 entitled "Continuous Manufacturing Device For Composite Metal Panel having Corrugation Core" has been proposed for the manufacture of a waveform panel.

As shown in FIG. 1, the continuous manufacturing device for the composite metal panel includes a core supply unit S, upper and lower metallic plate supply units E, adhesive supply units F, a joining unit L, a heating and compressing unit P, and a cooling unit M. The core supply unit S supplies a core 2 for the composite metal panel to the center of the joining unit L by a conveyor 1. The upper and lower metallic plate supply units E are provided above and below the core supply unit S to supply upper and lower metallic plates 3 and 3' from upper and lower metallic plate rolls 4 and 4' through rollers 5, 5', 6 and 6'. The adhesive supply units F are provided between the core supply unit S and the upper and lower metallic plate supply units E to supply hot melt adhesive film or adhesive layers 7 and 7' comprising adhesive attached at room temperature from film supplying rolls 7*a* and 7*a'*. The joining unit L includes upper and lower joining rolls 8 and 8' to join the upper and lower metallic plates 3 and 3', the adhesive layers 7 and 7' and the core 2, fed from the above units, together. The heating and compressing unit P includes upper and lower heating rollers 11 and compressing rollers 12 and 12' to heat and compress the joined part. The cooling unit M functions to cool the heated and compressed part. In the manufacturing device, the core supply unit S includes a metallic plate roll 13 for the core, and two pairs of large and small upper and lower toothed rollers 23, 23', 23*a* and 23*a'* having toothed gears 24 and 24' which compress a metallic plate 21 for the core supplied from the metallic plate roll 13 for the core, thus forming the corrugation core 2*a*. Caterpillars 28 and 28' are installed at upper and lower positions in the cooling unit M and are rotated in opposite directions by rollers 22 and 22' to press and punch a joined part for the composite metal panel.

However, the conventional continuous manufacturing device for the composite metal panel constructed as described above can form only a basic waveform using one corrugation core, but makes it difficult to form a composite waveform. Even if the composite waveform is formed, a plurality of corrugation cores must be prepared. Thus, a large installation space is required, the cost of the device increases, and it takes a long time to manufacture the panel having the waveform.

SUMMARY OF THE INVENTION

Accordingly, the present invention has been made keeping in mind the above problems occurring in the prior art, and an aspect of the present invention may provide an apparatus and method for forming a panel, in which a first process of forming a right triangular waveform on a plurality of base materials, a second process of forming an obtuse triangular waveform, and a third process of linearly pressing the base materials in a direction from front to rear to attach the base materials to each other are conducted by a single apparatus, thus allowing the panel to be rapidly formed.

The present invention may provide an apparatus for forming a panel having a lower mold which is fixed and an upper mold which is provided above the lower mold and reciprocates up and down in a vertical direction, and compressing a plurality of base materials fed to front ends of the lower and upper molds to form the panel. The apparatus includes a first mold unit, a second mold unit, and a third mold unit. The first mold unit includes a right-angled upper mold which is provided on a front portion of the upper mold and reciprocates up and down in the vertical direction, and a right-angled lower mold which is provided on a front portion of the lower mold to correspond to the right-angled upper mold and is fixed, thus compressing the base materials against each other to impart a pattern of a right triangular waveform. The second mold unit includes an obtuse upper mold which is provided on a central portion of the upper mold and reciprocates in a direction inclined relative to a direction of progression of the base materials, and an obtuse lower mold which is provided on a central portion of the lower mold to correspond to the obtuse upper mold and is fixed, thus compressing the base materials against each other to impart a pattern of an obtuse triangular waveform. The third mold unit is provided behind the second mold unit, and linearly presses the base materials compressed by the second mold unit in a direction from front to rear.

The right-angled upper mold may be provided with a lower surface having a shape of the right triangular waveform, and the right-angled lower mold may be provided with an upper surface having a shape of the right triangular waveform corresponding to the lower surface of the right-angled upper mold.

The obtuse upper mold may be provided with a lower surface having a shape of the obtuse triangular waveform and compresses the base materials compressed to have the pattern of the right triangular waveform such that a right-angled portion of the right triangular waveform is formed into an obtuse portion, and the obtuse lower mold may be provided with an upper surface having a shape of the obtuse triangular waveform corresponding to the lower surface of the obtuse upper mold. The obtuse upper mold may be elastically supported by the upper mold in such a way as to slidably reciprocate in a direction inclined relative to the direction of progression of the base materials.

The third mold unit may include an attaching upper mold having on a lower surface thereof a plurality of protruding pieces which protrude in a form of a straight line, and an attaching lower mold having on an upper surface thereof a plurality of support pieces which protrude to correspond to the protruding pieces, so that the base materials compressed to have the pattern of the obtuse triangular waveform are linearly pressed in the direction from front to rear by the plurality of protruding pieces and support pieces, and thus the base materials become attached to each other.

Further, the present invention may provide a method for forming a panel by compressing a plurality of base materials fed to front ends of a fixed lower mold and an upper mold provided above the lower mold to reciprocate up and down in a vertical direction, the method including compressing the plurality of base materials so that the base materials are imparted with a pattern of a right triangular waveform, compressing the plurality of base materials, compressed to have the pattern of the right triangular waveform, so that the base materials are imparted with a pattern of an obtuse triangular waveform, and linearly pressing the plurality of base materials, compressed to have the pattern of the obtuse triangular waveform, in a direction from front to rear, thus attaching the base materials to each other.

BRIEF DESCRIPTION OF THE DRAWINGS

Further feature as well as the structure and operation of various embodiments are detail below with reference to the accompanying drawings, in which.

DESCRIPTION OF THE PREFERRED EMBODIMENTS

Figure 1:
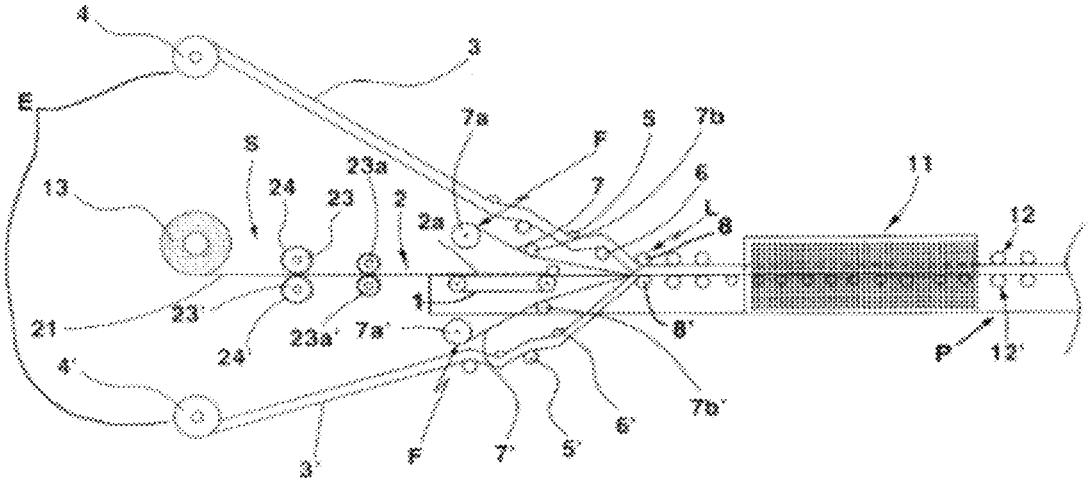
FIG. 1 is a schematic front view illustrating a conventional continuous manufacturing device for a composite metal panel.
Figure 1:
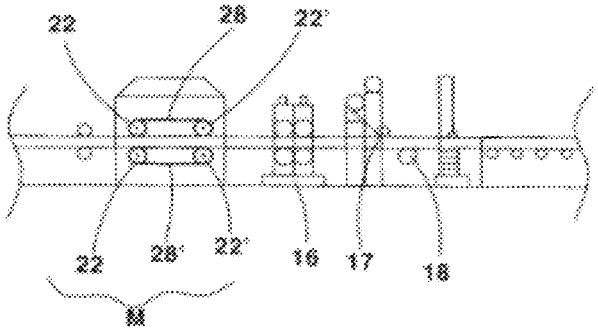

The present invention will be more clearly understood with reference to the embodiment illustrated in the accompanying drawings. Hereinafter, the embodiment of the present invention will be described in detail such that those skilled in the art can easily understand and embody this invention.

A panel forming apparatus according to an embodiment of the present invention may include a fixed lower mold 20 and an upper mold 10 which is placed above the lower mold 20 to reciprocate up and down in a vertical direction, and compresses a plurality of base materials 32 and 34 fed to the front ends of the molds 10 and 20, thus forming one panel. The apparatus includes a first mold unit 100, a second mold unit 200, and a third mold unit 300.

First, the first mold unit 100 will be described.

Figure 2:
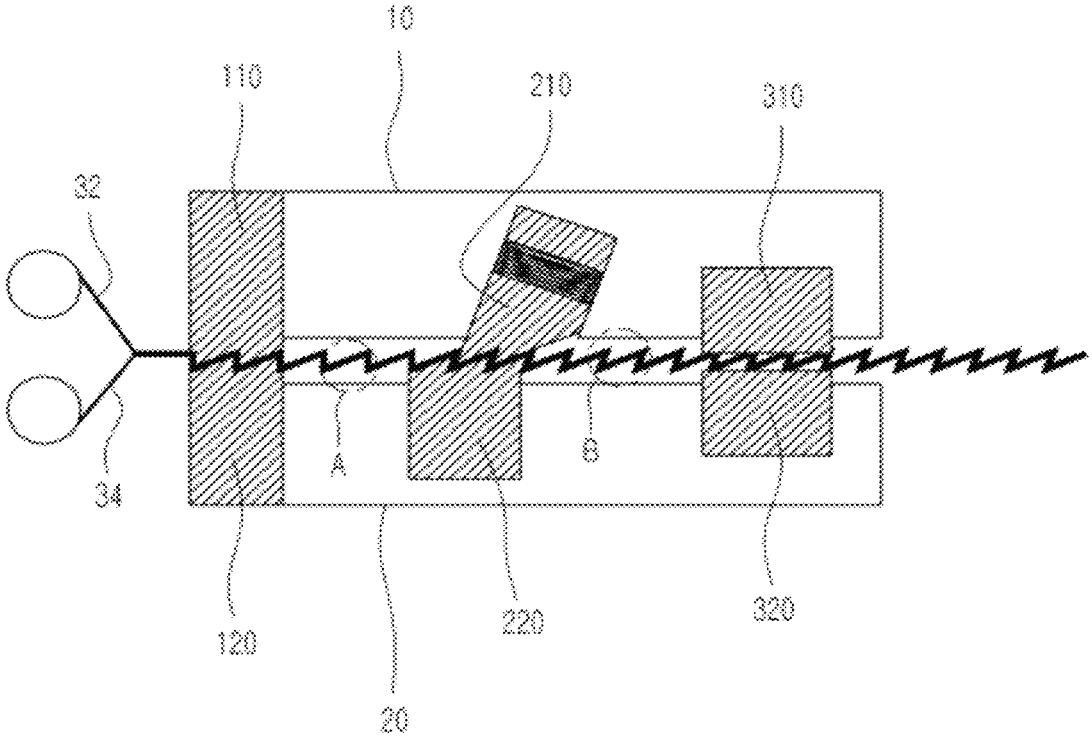
FIGS. 2 and 3 are schematic views illustrating the schematic construction of a panel forming apparatus according to an embodiment of the present invention.
Figure 3:
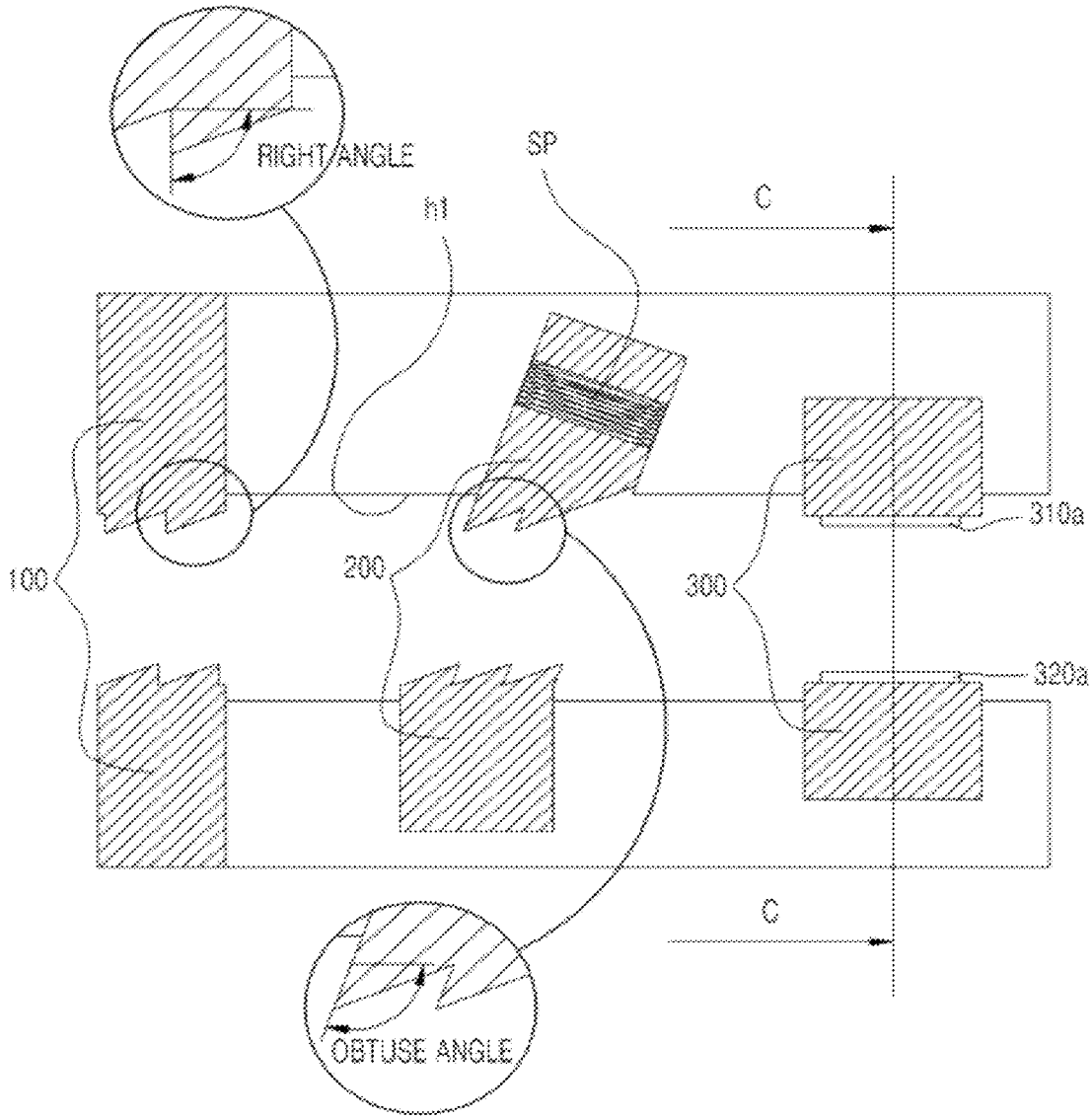

As shown in FIGS. 2 and 3, the first mold unit 100 includes a right-angled upper mold 110 and a right-angled lower mold 120.

The right-angled upper mold 110 is provided on the front portion of the upper mold 10 and reciprocates up and down in a vertical direction integrally with the upper mold 10. The right-angled lower mold 120 is provided on the front portion of the lower mold 20 to correspond to the right-angled upper mold 110 and is integrally secured to the lower mold 20.

In the right-angled upper mold 110 and the right-angled lower mold 120 constructed as described above, when the upper mold 10 is moved downwards, the lower surface of the right-angled upper mold 110 approaches the upper surface of the right-angled lower mold 120, thus compressing the plurality of base materials 32 and 34 against each other.

Here, the base materials 32 and 34, fed to the front ends of the upper mold 10 and the lower mold 20, pass through a space between the right-angled upper mold 110 and the right-angled lower mold 120.

Meanwhile, the right-angled upper mold 110 is provided with a lower surface having the shape of a right triangular waveform A, and the right-angled lower mold 120 is provided with an upper surface having the shape of the right triangular waveform A to correspond to the lower surface of the right-angled upper mold 110. The base materials 32 and 34 fed between the right-angled upper mold 110 and the right-angled lower mold 120 are compressed against each other as the lower surface of the right-angled upper mold 110 approaches the upper surface of the right-angled lower mold 120, thus obtaining the pattern of the right triangular waveform A.

As described above, the base materials 32 and 34 are compressed against each other by the right-angled upper mold 110 and the right-angled lower mold 120, thus forming the pattern of the right triangular waveform A.

Next, the second mold unit 200 will be described.

As shown in FIGS. 2 and 3, the second mold unit 200 includes an obtuse upper mold 210 and an obtuse lower mold 220.

The obtuse upper mold 210 is provided on the central portion of the upper mold 10 and reciprocates in a direction inclined relative to the progressing direction of the base materials 32 and 34. The obtuse lower mold 220 is provided on the central portion of the lower mold 20 to correspond to the obtuse upper mold 210 and is integrally secured to the lower mold 20.

Here, the obtuse upper mold 210 is elastically supported by the upper mold 10 to slidably reciprocate in the direction inclined relative to the progressing direction (a direction from the left side of FIG. 2 to the right side) of the base materials 32 and 34.

For example, as shown in FIG. 3, a sliding hole h1 is formed in the central portion of the upper mold 10 such that the obtuse upper mold 210 is obliquely installed. The obtuse upper mold 210 is inserted into the sliding hole h1 in such a way as to slidably reciprocate in a direction inclined relative to the progressing direction of the base materials 32 and 34.

The obtuse upper mold 210 is inserted into the sliding hole h1 with an elastic member such as a spring being interposed between the obtuse upper mold 210 and the sliding hole h1. Thus, the obtuse upper mold 210 may slidably reciprocate in the direction inclined relative to the progressing direction of the plurality of base materials 32 and 34.

That is, when the obtuse upper mold 210 compresses the plurality of base materials 32 and 34, the obtuse upper mold 210 slides obliquely into the sliding hole h1. Meanwhile, when the obtuse upper mold 210 does not compress the plurality of base materials 32 and 34, the obtuse upper mold 210 slides obliquely out from the sliding hole h1.

As such, in the state where the obtuse upper mold 210 is provided in the sliding hole h1 in such a way as to be elastically and slidably reciprocated, when the upper mold 10 is operated downwards, the lower surface of the obtuse upper mold 210 elastically approaches the upper surface of the obtuse lower mold 220. Thereby, the base materials 32 and 34 having the right triangular waveform A formed by the first mold unit 100 are compressed against each other.

Meanwhile, the obtuse upper mold 210 is provided with a lower surface having the shape of an obtuse triangular waveform B such that the right-angled portion of the right triangular waveform A of the base materials 32 and 34, compressed to make the pattern of the right triangular waveform A by the first mold unit 100, has an obtuse angle. The obtuse lower mold 220 is provided with an upper surface having the shape of the obtuse triangular waveform B to correspond to the lower surface of the obtuse upper mold 210. The base materials 32 and 34, fed between the obtuse upper mold 210 and the obtuse lower mold 220, are elastically compressed against each other as the lower surface of the obtuse upper mold 210 elastically approaches the upper surface of the obtuse lower mold 220. Thereby, the base materials 32 and 34 are compressed to form a pattern of the obtuse triangular waveform B.

As described above, the base materials 32 and 34 are compressed by the obtuse upper mold 210 and the obtuse lower mold 220, so that a pattern of the base materials 32 and 34 changes from the right triangular waveform A to the obtuse triangular waveform B. Further, the obtuse upper mold 210 and the obtuse lower mold 220 elastically compress the plurality of base materials 32 and 34, thus preventing the base materials 32 and 34 from tearing or being damaged.

Next, the third mold unit 300 will be described.

As shown in FIGS. 2 and 3, the third mold unit 300 is provided behind the second mold unit 200 and linearly presses the base materials 32 and 34 having the pattern of the obtuse triangular waveform B by the compression of the second mold unit 200, in a direction from front to rear, so that the base materials 32 and 34 become attached to each other. Further, the third mold unit 300 includes an attaching upper mold 310 and an attaching lower mold 320.

Figure 4:
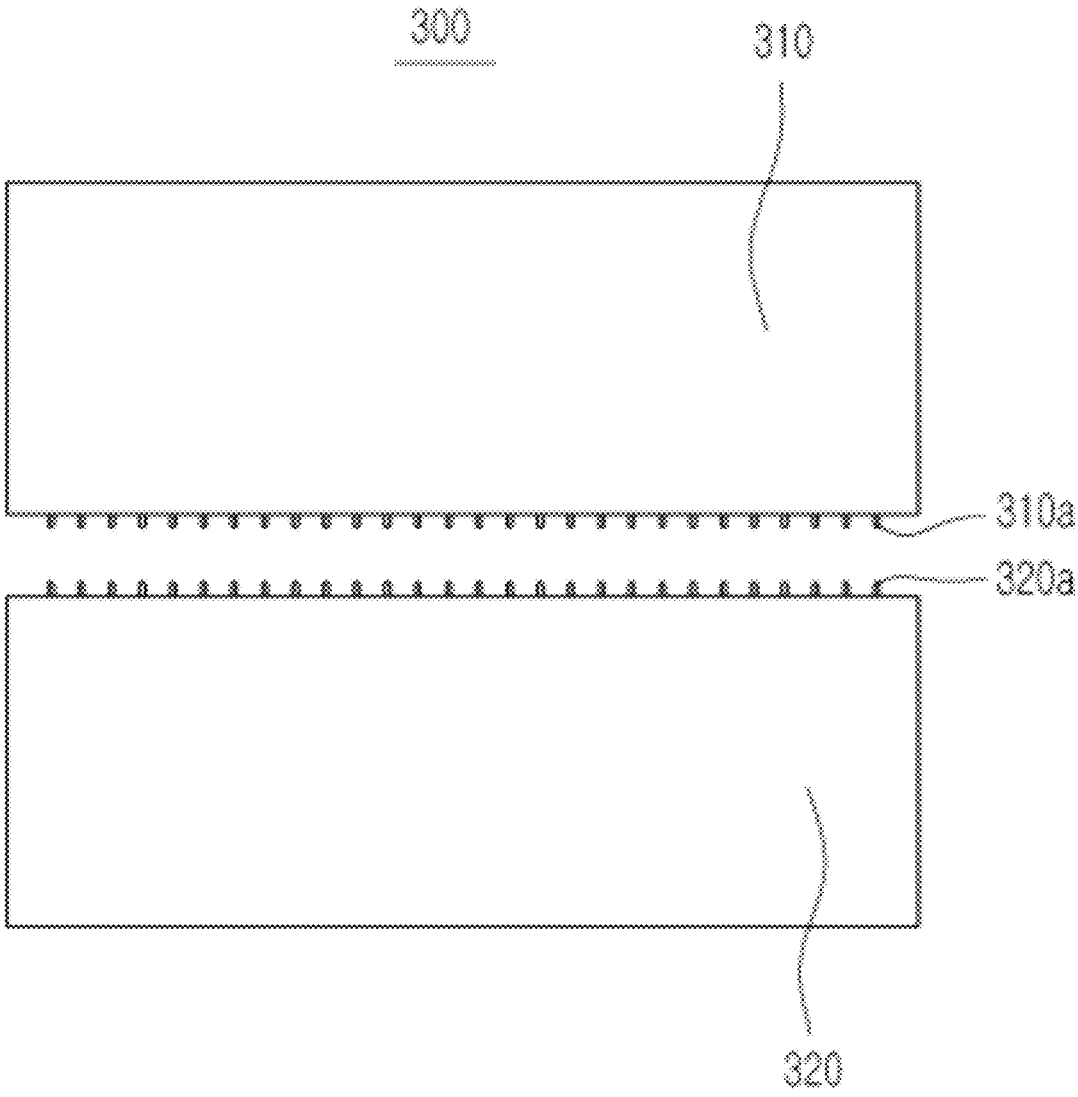
FIG. 4 is a schematic view illustrating a third mold unit of the panel forming apparatus according to the embodiment of the present invention.

FIG. 4 is a sectional view taken along line "C-C" of FIG. 3. As shown in FIG. 4, the attaching upper mold 310 is provided with a lower surface having a plurality of protruding pieces 310*a* which protrude in the form of a straight line, and reciprocates in a vertical direction integrally with the upper mold 10. The attaching lower mold 320 is provided with an upper surface having a plurality of support pieces 320*a* which protrude to correspond to the plurality of protruding pieces 310*a*, and is integrally secured to the lower mold 20.

Figure 5:
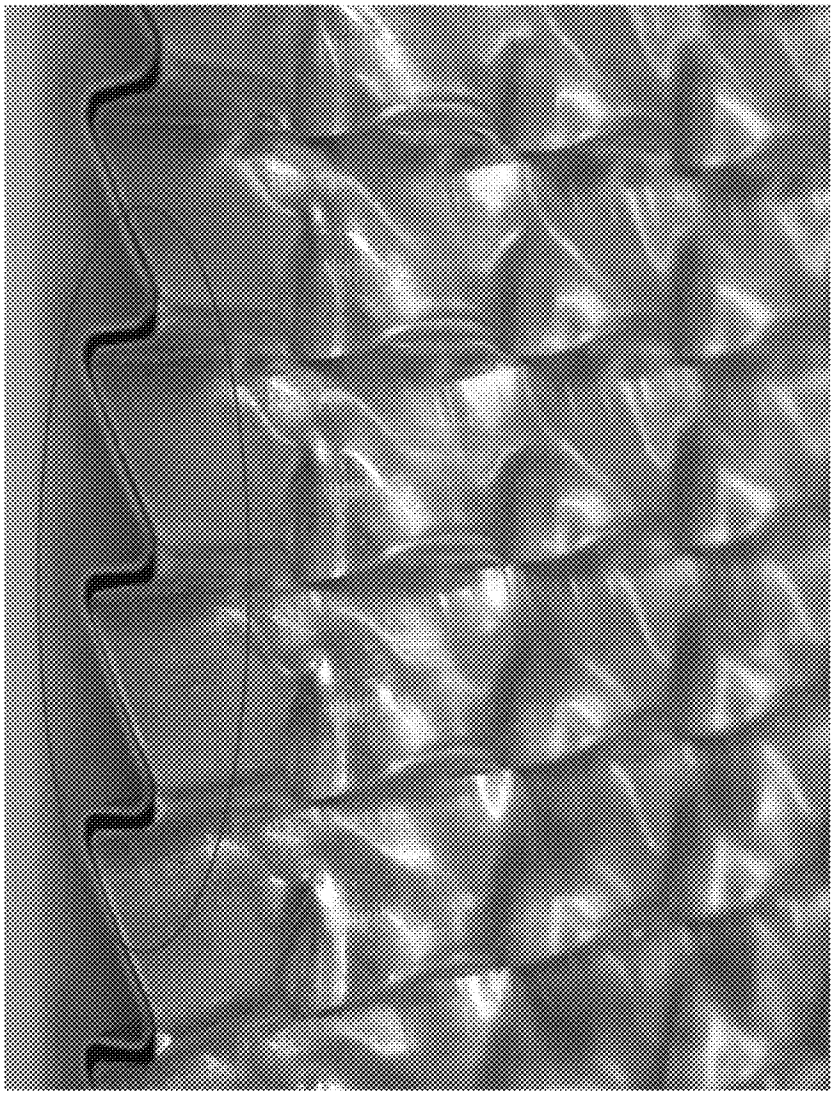
FIGS. 5 and 6 are photographs illustrating a panel which is manufactured by the panel forming apparatus of the present invention.
Figure 6:
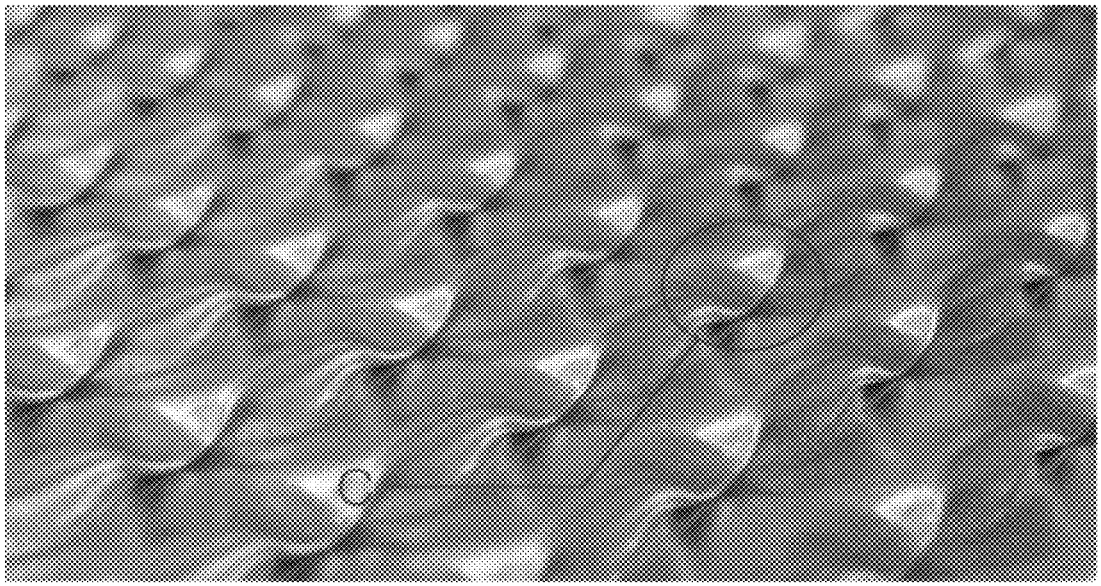

After the base materials 32 and 34 having the pattern of the right triangular waveform A are formed to have the pattern of the obtuse triangular waveform B by the second mold unit 200, the third mold unit 300 compresses the base materials 32 and 34, thus obtaining the shape of a product as shown in FIGS. 5 and 6.

That is, the protruding pieces 310*a* of the attaching upper mold 310 approach the support pieces 320*a* of the attaching lower mold 320, so that the "crests" of the obtuse triangular waveform B, formed on the base materials 32 and 34 and having the "crests" and the "roots", are compressed. When the plurality of panels having the pattern of the obtuse triangular waveform B overlap each other and the "crests" are compressed, the base materials 32 and 34 are pressed linearly in a direction from the front position of the base materials 32 and 34 to the rear position thereof, so that the "crests" are compressed as shown in FIG. 6 (designated by reference character C and hereinafter referred to as the "clinched part").

As such, in the state where the plurality of base materials 32 and 34 overlap each other, a plurality of clinched parts C is formed by the third mold unit 300. Thus, the base materials 32 and 34 may be attached to each other without an additional means for attaching the base materials 32 and 34 to each other.

As described above, the base materials 32 and 34 are compressed to form the clinched parts C by the attaching upper mold 310 and the attaching lower mold 320, so that the base materials 32 and 34 become attached to each other.

Finally, the method for forming the panel using the first mold unit 100, the second mold unit 200, and the third mold unit 300, as shown in FIGS. 5 and 6, will be described.

The method includes a right-angled waveform forming process, an obtuse waveform forming process, and an attaching process. In the right-angled waveform forming process, the base materials 32 and 34 are compressed to have the pattern of the right triangular waveform A.

In the state where the base materials 32 and 34 are placed on the right-angled lower mold 120, the upper mold 10 is operated downwards. At this time, the right-angled upper mold 110 is also operated downwards, so that the base materials 32 and 34 are compressed to have the pattern of the right triangular waveform A.

In the obtuse waveform forming process, the base materials 32 and 34, compressed to have the pattern of the right triangular waveform A, are compressed to have the pattern of the obtuse triangular waveform B.

In the state where the base materials 32 and 34 compressed to have the pattern of the right triangular waveform A are placed on the obtuse lower mold 220, the upper mold 10 is operated downwards. Simultaneously, the obtuse upper mold 210 is obliquely operated downwards. Thereby, the base materials 32 and 34 are compressed so that the pattern is changed from the right triangular waveform A to the obtuse triangular waveform B.

In the attaching process, the base materials 32 and 34 compressed to have the pattern of the obtuse triangular waveform B are compressed linearly in a direction from front to rear, so that the base materials 32 and 34 are attached to each other.

The base materials 32 and 34 compressed to have the pattern of the obtuse triangular waveform B are placed on the attaching lower mold 320. In such a state, as the upper mold 10 is operated downwards, the attaching upper mold 310 is also operated downwards, so that the "crests" of the obtuse triangular waveform formed on the base materials 32 and 34 are simultaneously compressed linearly, and thus the base materials 32 and 34 are attached to each other.

As described above, the present invention may provide an apparatus and method for forming a panel, in which a first process of forming a right triangular waveform on a plurality of base materials, a second process of forming an obtuse triangular waveform, and a third process of linearly pressing the base materials in a direction from front to rear to attach the base materials to each other are conducted by a single apparatus, thus allowing the panel to be rapidly formed.

Although the embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An apparatus for forming a panel having a lower mold which is fixed and an upper mold which is provided above the lower mold and reciprocates up and down in a vertical direction, and compressing a plurality of base materials fed to front ends of the lower and upper molds to form the panel, the apparatus comprising:

a first mold unit including a right-angled upper mold which is provided on a front portion of the upper mold and reciprocates up and down in the vertical direction, and a right-angled lower mold which is provided on a front portion of the lower mold to correspond to the right-angled upper mold and is fixed, thus compressing the base materials against each other to impart a pattern of a right triangular waveform;

a second mold unit including an obtuse upper mold which is provided on a central portion of the upper mold and reciprocates in a direction inclined relative to a direction of progression of the base materials, and an obtuse lower mold which is provided on a central portion of the lower mold to correspond to the obtuse upper mold and is fixed, thus compressing the base materials against each other to impart a pattern of an obtuse triangular waveform; and a third mold unit provided behind the second mold unit, and linearly pressing the base materials compressed by the second mold unit in a direction from front to rear.

2. The apparatus as set forth in claim 1, wherein the right-angled upper mold is provided with a lower surface having a shape of the right triangular waveform, and the right-angled lower mold is provided with an upper surface having a shape of the right triangular waveform corresponding to the lower surface of the right-angled upper mold.

3. The apparatus as set forth in claim 1, wherein the obtuse upper mold is provided with a lower surface having a shape of the obtuse triangular waveform and compresses the base materials compressed to have the pattern of the right triangular waveform such that a right-angled portion of the right triangular waveform is formed into an obtuse portion, and the obtuse lower mold is provided with an upper surface having a shape of the obtuse triangular waveform corresponding to the lower surface of the obtuse upper mold.

4. The apparatus as set forth in claim 3, wherein the obtuse upper mold is elastically supported by the upper mold in such a way as to slidably reciprocate in a direction inclined relative to the direction of progression of the base materials.

5. The apparatus as set forth in claim 1, wherein the third mold unit comprises an attaching upper mold having on a lower surface thereof a plurality of protruding pieces which protrude in a form of a straight line, and an attaching lower mold having on an upper surface thereof a plurality of support pieces which protrude to correspond to the protruding pieces, so that the base materials compressed to have the pattern of the obtuse triangular waveform are linearly pressed in the direction from front to rear by the plurality of protruding pieces and support pieces, and thus the base materials become attached to each other.

6. A method for forming a panel by compressing a plurality of base materials fed to front ends of a fixed lower mold and an upper mold provided above the lower mold to reciprocate up and down in a vertical direction, the method comprising:

compressing the plurality of base materials so that the base materials are imparted with a pattern of a right triangular waveform;

compressing the plurality of base materials, compressed to have the pattern of the right triangular waveform, so that the base materials are imparted with a pattern of an obtuse triangular waveform; and linearly pressing the plurality of base materials, compressed to have the pattern of the obtuse triangular waveform, in a direction from front to rear, thus attaching the base materials to each other.

* * * * *